US011540595B2

(12) United States Patent
Glancy et al.

(10) Patent No.: US 11,540,595 B2
(45) **Date of Patent: *Jan. 3, 2023**

(54) ATHLETIC CLEAT

(71) Applicant: Under Armour, Inc., Baltimore, MD (US)

(72) Inventors: Michael Glancy, Baltimore, MD (US); Michael Forsey, Portland, OR (US)

(73) Assignee: Under Armour, Inc., Baltimore, MD (US)

( * ) Notice: Subject to any disclaimer, the term of this patent is extended or adjusted under 35 U.S.C. 154(b) by 123 days.

This patent is subject to a terminal disclaimer.

(21) Appl. No.: 16/781,611

(22) Filed: Feb. 4, 2020

(65) Prior Publication Data

US 2020/0170353 A1 Jun. 4, 2020

Related U.S. Application Data

(63) Continuation of application No. 15/598,254, filed on May 17, 2017, now Pat. No. 10,568,391.

(60) Provisional application No. 62/337,585, filed on May 17, 2016.

(51) Int. Cl.

| | |
|---|---|
| ***A43C 15/16*** | (2006.01) |
| ***A43B 5/00*** | (2022.01) |
| ***A43B 3/00*** | (2022.01) |
| ***A43B 13/26*** | (2006.01) |

(52) U.S. Cl.

CPC ..... *A43C 15/162* (2013.01); *A43B 3/0042* (2013.01); *A43B 5/001* (2013.01); *A43B 13/26* (2013.01); *A43C 15/161* (2013.01)

(58) Field of Classification Search

CPC ..... A43C 15/162

See application file for complete search history.

(56) References Cited

U.S. PATENT DOCUMENTS

| | | | |
|---|---|---|---|
| 3,082,549 | A | 3/1963 | Dolceamore |
| 4,754,561 | A | 7/1988 | Dufour |
| 4,875,683 | A | 10/1989 | Wellman |
| 5,964,048 | A | 10/1999 | Shieh |
| 6,016,613 | A | 1/2000 | Campbell et al. |
| 6,675,505 | B2 | 1/2004 | Terashima |
| 6,705,027 | B1 | 3/2004 | Campbell |
| 6,817,117 | B1 | 11/2004 | Campbell |
| 6,834,446 | B2 | 12/2004 | McMullin |
| 7,559,160 | B2 | 7/2009 | Kelly |
| 7,650,707 | B2 | 1/2010 | Campbell |

(Continued)

FOREIGN PATENT DOCUMENTS

| | | |
|---|---|---|
| EP | 1993391 B1 | 9/2012 |
| JP | 2012139348 | 7/2012 |

*Primary Examiner* — Jila M Mohandesi

(74) *Attorney, Agent, or Firm* — Maginot, Moore & Beck LLP

(57) ABSTRACT

An article of footwear includes an upper and a sole connected to the upper. The sole includes a plurality of cleat mounts. A plurality of cleats is releasably connected to the cleat mounts of the sole. Each of the plurality of cleats includes a mount coupling and a plurality of legs connected to the mount coupling. The mount coupling is configured to engage one of the plurality of cleat mounts and releasably connect the cleat to the sole. The plurality of legs includes at least one lateral leg having a first hardness and at least one medial leg having a second hardness, the first hardness different from the second hardness.

20 Claims, 11 Drawing Sheets

(56) References Cited

U.S. PATENT DOCUMENTS

| | | | | |
|---|---|---|---|---|
| 7,726,047 | B1 * | 6/2010 | MacNeill | A43C 15/164 36/134 |
| 7,895,773 | B2 | 3/2011 | Robinson | |
| 8,020,322 | B2 * | 9/2011 | McMullin | A43C 15/162 36/134 |
| 8,245,422 | B2 * | 8/2012 | Krikorian | A43C 15/06 36/134 |
| 8,375,604 | B2 | 2/2013 | Eder | |
| 8,671,594 | B2 * | 3/2014 | Ortley | A43C 15/16 36/134 |
| 8,806,779 | B2 * | 8/2014 | Auger | A43B 5/02 36/67 A |
| 9,220,320 | B2 * | 12/2015 | Auger | A43B 5/00 |
| 9,883,716 | B2 * | 2/2018 | Jones | A43B 5/00 |
| 10,398,198 | B2 * | 9/2019 | Orand | A43B 13/122 |
| 2002/0144439 | A1 | 10/2002 | Price | |
| 2006/0090373 | A1 | 5/2006 | Savoie | |
| 2007/0199213 | A1 | 8/2007 | Campbell | |
| 2008/0271346 | A1 | 11/2008 | Farmer | |
| 2013/0333247 | A1 | 12/2013 | Grott | |
| 2016/0015120 | A1 | 1/2016 | Denison et al. | |

* cited by examiner

ATHLETIC CLEAT

CROSS-REFERENCE TO RELATED APPLICATIONS

This document is a continuation of U.S. patent application Ser. No. 15/598,254, filed May 17, 2017, which claims priority to U.S. provisional patent application Ser. No. 62/337,585 filed May 17, 2016, the entire contents of which are incorporated herein by reference.

FIELD

This document relates to the field of athletics, and particularly to athletic cleats.

BACKGROUND

Cleats are commonly used by athletes participating in any of various sports and other athletic activities. The configuration and arrangement of cleats on the sole of the shoe typically varies from sport-to-sport in order to provide the athlete with desired ground engagement when participating in a particular sport.

In the sport of golf, cleats contribute to stabilizing the golfer during backswing, downswing, and follow-through. Each golfer has a unique swing resulting in different traction and stability requirements on the foot of the user during the swing. As a result, golfers with different types of swings may be interested in different levels of stability and traction in different locations on the sole of the golf shoe.

In view of the foregoing, it would be advantageous to provide a cleat configured to provide unique athletic performance characteristics not offered by other cleats. In addition, it would be advantageous to provide a cleat that is capable of being configured differently on the shoe for different athletes depending on the athlete's unique motion. It would also be advantageous if the cleat could be manufactured relatively easily and at a reasonable cost.

SUMMARY

According to at least one embodiment of the disclosure, a cleat for an article of footwear includes a mount coupling, a hub, and a plurality of legs. The mount coupling is provided on an upper side of the cleat and configured to engage a sole of the article of footwear. The hub is provided on a lower side of the cleat and is connected to the mount coupling. The plurality of legs extend from the hub. The plurality of legs include at least one first leg on a medial side of the hub and at least one second leg on a lateral side of the hub. The at least one first leg is comprised of a first material having a first hardness and the at least one second leg comprised of a second material having a second hardness. The first hardness is different from the second hardness. The first material surrounds the mount coupling on the upper side of the cleat.

In at least one embodiment of the disclosure and article of footwear includes an upper, a sole, a plurality of first cleats and a plurality of second cleats. The sole is connected to the upper and includes a plurality of cleat mounts. The plurality of first cleats is releasably connected to the cleat mounts on a lateral side of the sole. Each of the plurality of first cleats includes a mount coupling, a hub connected to the mount coupling, and a plurality of legs connected to the hub. The mount coupling releasably engages one of the plurality of cleat mounts. The plurality of legs include one or more static legs on a first side of the hub and one or more dynamic legs on a second side of the hub. All of the one or more static legs have a first hardness and all of the one or more dynamic legs have a second hardness. The plurality of second cleats is releasably connected to the cleat mounts on a medial side of the sole. Each of the plurality of second cleats have a limited number of legs, wherein all of the limited number of legs share a common hardness.

Pursuant to yet another exemplary embodiment of the disclosure, an article of footwear comprises at least one first cleat mounted on a lateral side of the article of footwear and a least one second cleat mounted on a medial side of the article of footwear. The at least one first cleat includes at least one lateral leg and at least one medial leg, the at least one lateral leg having a first hardness and at least one medial leg having a second hardness, wherein the first hardness is greater than the second hardness. The at least one second cleat includes legs, and all the legs of the at least one second cleat have a same hardness that is less than the first hardness.

The above described features and advantages, as well as others, will become more readily apparent to those of ordinary skill in the art by reference to the following detailed description and accompanying drawings. While it would be desirable to provide an athletic cleat that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
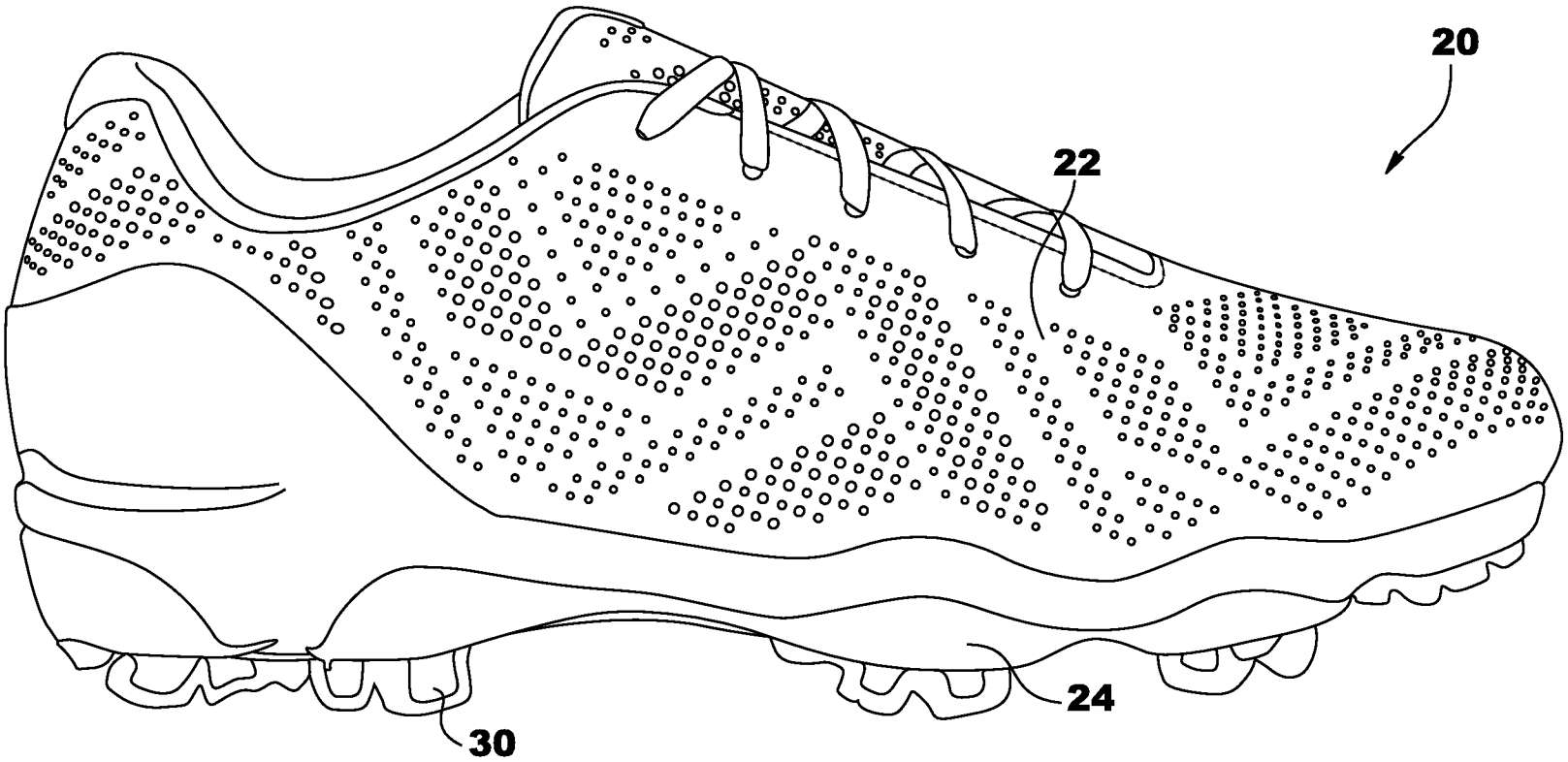
FIG. 1 shows a lateral side view of an article of footwear including athletic cleats in the form of a golf shoe with a plurality of golf cleats.

With In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As used herein, an "article of footwear" refers to an article of apparel designed and configured to be worn on a user's foot. Examples of articles of footwear include, but are not limited to: athletic shoes such as basketball shoes, running shoes, walking shoes, and tennis shoes; athletic cleated or spiked shoes such as golf shoes, football cleats, soccer cleats, baseball cleats, lacrosse cleats, and track spikes; boots such as hiking boots or skiing boots; ice skates; and roller skates or roller blades. The illustrated embodiments depict golf cleats, though the reader should appreciate that the midsole described herein may be used with any desired article of footwear.

With reference now to FIGS. 1-5, an article of footwear is shown in the form of a cleated shoe and, in particular, golf shoe 20. The golf shoe 20 includes an upper 22 coupled (e.g., connected) to a sole 24 with a plurality of cleats 30 provided on the sole 24. The upper 22 includes a plurality of components that cover the foot of a wearer when the article of footwear 20 is worn on the foot. Exemplary components of the upper 22 include a heel (or heel counter), a tongue, a vamp, and a toe (or toe cap), along with any of various other components as will be recognized by those of ordinary skill in the art. While the configuration of the upper 22 disclosed herein provides a low-cut shoe, the article of footwear may also be provided in the form of a high-top shoe, a boot, a sandal, or any of various other types of footwear.

In addition to being provided in any of various forms and configurations, the upper 22 may also be comprised of any of various materials. For example, the upper 22 may include one or more panels comprised of polyester, elastane, mesh, synthetic leather or natural leather, or any of various other materials or combinations thereof. Additionally, the upper may include additional materials and components such as foam padding, polymer sheets, fastening members, support structures, as well as any of various other materials and components. The materials and components used on the upper 22 may depend, in part, on the particular type of footwear formed by the upper 22.

Figure 16A:
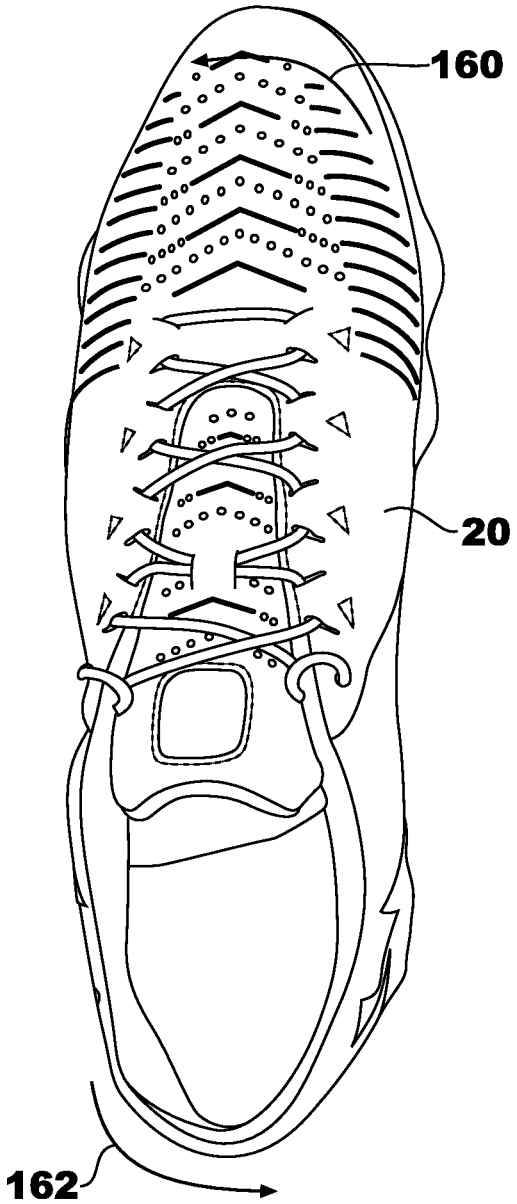
FIG. 16A shows the shoe of FIG. 1 with counter-clockwise rotational forces applied thereto.

The sole 24 generally includes a midsole and an outsole or plate 27. The midsole may be formed of a compressible material such as foam (e.g., ethylene vinyl acetate foam. The outsole 27 may be formed of a resilient elastomer such as thermoplastic polyurethane. The downward- or ground-facing surface 26 of the outsole includes a clear system operable to provide directional and, in particular, rotational traction during game play, in particular, during the backswing, down swing, and/or follow-through of a golf swing. During a golf swing, a golfer rotates their hips, swings their arms, and shifts their weight and how their weight is distributed on their feet. These movements of the golfer during the golf swing leads to forces that result in the rotation of the feet. More specifically, the lead foot of the golfer (e.g., the left foot of the right handed golfer) wants to rotate such that the forefoot rotates in the lateral direction (i.e., a counter-clockwise direction for a right handed golfer) direction while the heel end rotates in the medial direction (i.e., also a counter-clockwise direction for a right handed golfer). An illustration of these forces is shown in FIG. 16A, with arrow 160 illustrating forces on the forefoot, and arrow 162 illustrating forces on the heel end. Conventional golf shoes with standard cleat systems fail to properly account for this rotation, allowing the feet of golfers to rotate, resulting in inconsistent and/or inaccurate golf shots.

Figure 2:
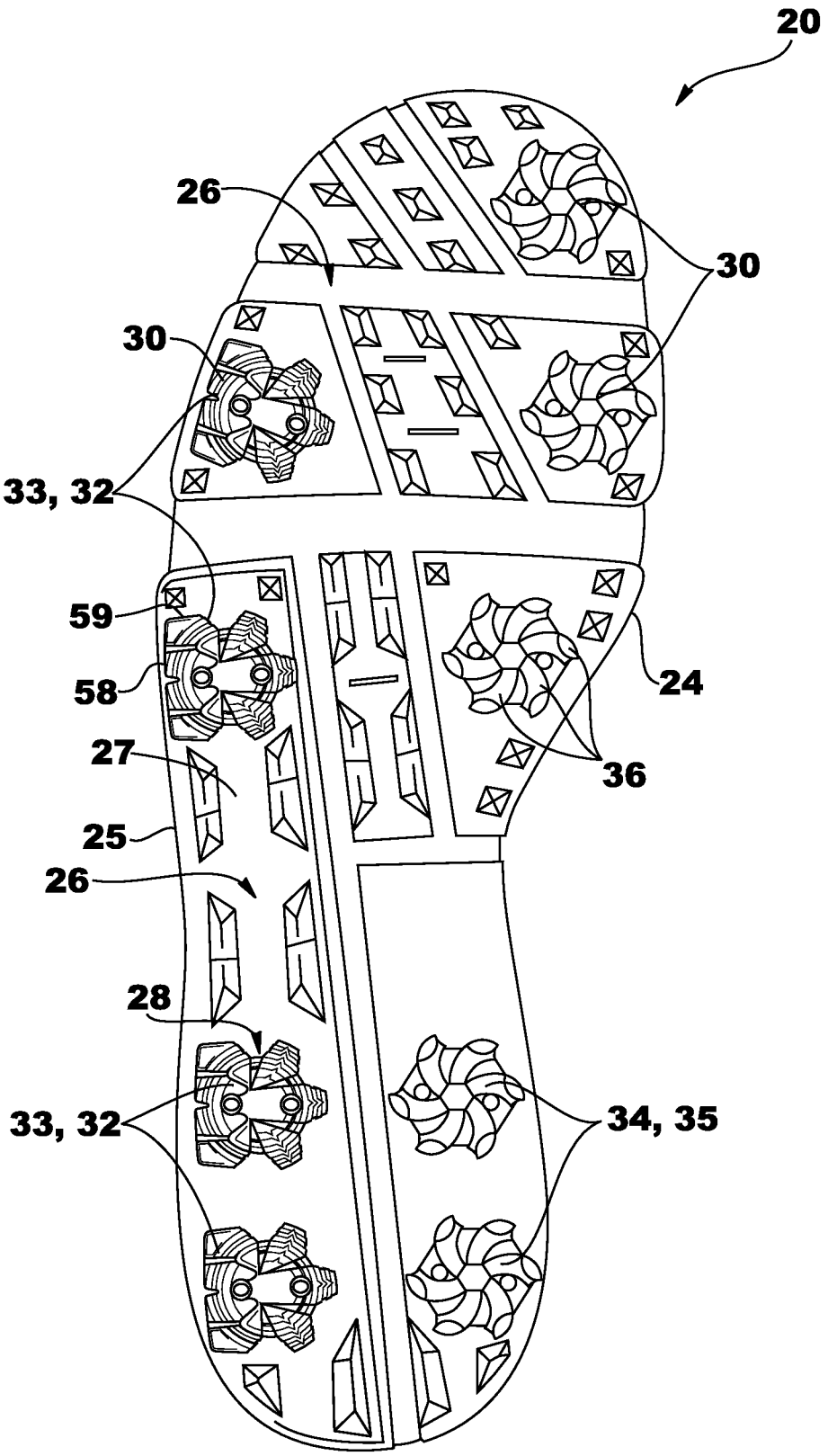
FIG. 2 shows a bottom plan view of the golf shoe and golf cleats of FIG. 1.

With particular reference to FIG. 2, the ground-facing side or the sole 24 includes a plurality of cleat mounts 28. Each cleat mount 28 is configured to releasably receive a cleat 30. In at least one embodiment, the cleat mounts 28 receive the cleats 30 in a quick-lock engagement such that each cleat 30 may be easily secured to a cleat mounts 28 with a partial turn of the cleat 30 in one direction, and removed from the cleat mount 28 with a partial turn of the cleat 30 in the opposite direction. The cleat mounts 28 are arranged on the sole 24 to position each cleats 30 in a pre-determined orientation, as described in further detail below.

The cleats 30 include a plurality of stability cleats 33 and a plurality of standard cleats 35. As described in further detail below with reference to FIGS. 1-9, the stability cleats 33 include one or more static traction elements 50 (which may also be referred to herein as static legs 50) and one or more dynamic traction elements 60 (which may also be referred to herein as dynamic legs 60). Static legs 50 are defined by a first durometer value, while the dynamic legs 60 are defined by a second durometer value that is lower than the first durometer value (on the same hardness scale). In an embodiment, the stability cleat 33 is formed of an elastomer such as thermoplastic polyurethane, with the dynamic legs 60 possessing a hardness value of 80 Shore A to 100 Shore A, and the static legs 50 possessing a hardness value of 60 Shore D to 80 Shore D. Accordingly, dynamic legs 60 tend to resiliently flex under load, while static legs 50 are generally rigid and inflexible.

The static and dynamic legs of the stability cleats 33 are oriented on a generally circular hub 39 such that the static leg spans one hemisphere of the hub 39 and the dynamic legs span the other hemisphere of the hub 39 (with the equator being aligned with the longitudinal axis of the sole). In general, each stability cleat 33 may be positioned in one or two angular orientations. In a first orientation, the static leg is positioned outboard, facing the sole perimeter. In this orientation, the static leg is positioned to resist foot rotation. In a second orientation, the dynamic legs are positioned outboard (i.e., facing the sole perimeter). With this second orientation, the stability cleats 33 function similar to standard cleats, permitting rotation (relative to the static cleats in the first orientation).

With this configuration, a user may customize the rotational traction of each shoe based on the user's performance tendencies. By way of example, a user who experiences prominent forefoot rotation during the swing (counter clockwise rotation in the left foot and clockwise rotation in the right foot) may couple the stability cleats 33 to the lateral forefoot receptacles of the sole the first orientation to inhibit rotation of the forefoot during game play (e.g., the golf swing). Similarly, a user who experiences prominent rearfoot (heel) rotation may couple the stability cleats to the medial rearfoot receptacles in the first orientation to inhibit such rotation. Specific cleat structures and cleat layouts are discussed in greater detail, below.

Standard cleats 35 may be coupled to the sole at desired receptacle locations. In an embodiment, standard cleats include dynamic traction elements that are secured to and project downwardly and outwardly from a hub 39 and resiliently flex under the load of the weight of a wearer.

Turning to specific embodiments, in FIGS. 1-5, the stability cleats 33 are provided as lateral cleats 32 mounted along a lateral side of the golf shoe 20 and the standard cleats are provided as medial cleats 34 mounted along a medial side of the golf shoe 20. The plurality of lateral cleats 32 differs from the plurality of medial cleats 34. As explained in further detail below, the plurality of lateral cleats 32 include different types of legs of differing hardness. In contrast, all of the legs 36 on the medial cleats 34 have the same form and the same hardness. The medial cleats 34 may be provided by any number of different commercially available golf cleats having a generally uniform construction, such as those golf cleats offered under the CHAMP® trademark, the SOFTSPIKES® trademark, or any of various other commercially available golf cleats. While the stability cleats 33 are provided in the embodiment of FIGS. 1-5 as lateral cleats 32, and the standard cleats 35 are provided in the embodiment of FIGS. 1-5 as medial cleats 34, it will be recognized that the stability cleats and the standard cleats may be provided in any of various configurations on the sole 24, including stability cleats 33 provided on the medial side of the shoe 20 and standard cleats 35 provided on the lateral side of the shoe 20. Examples of such arrangements are described in further detail below, including those arrangements discussed associated with FIGS. 13, 16A and 16B.

Figure 3:
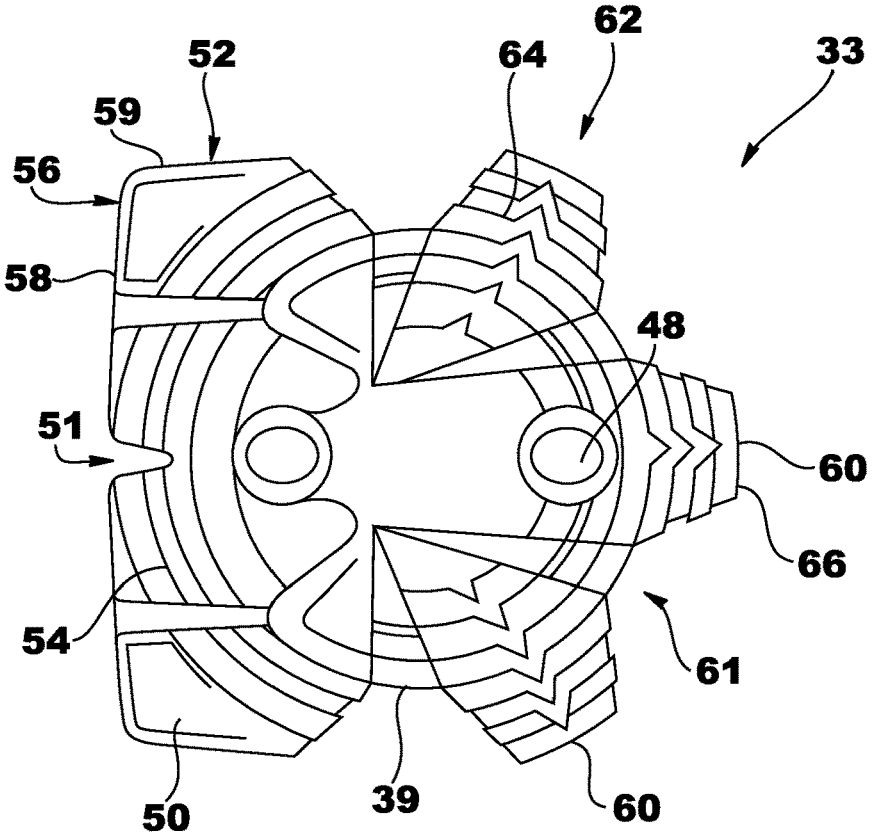
FIG. 3 shows a bottom plan view of one of the golf cleats of FIG. 2.
Figure 4:
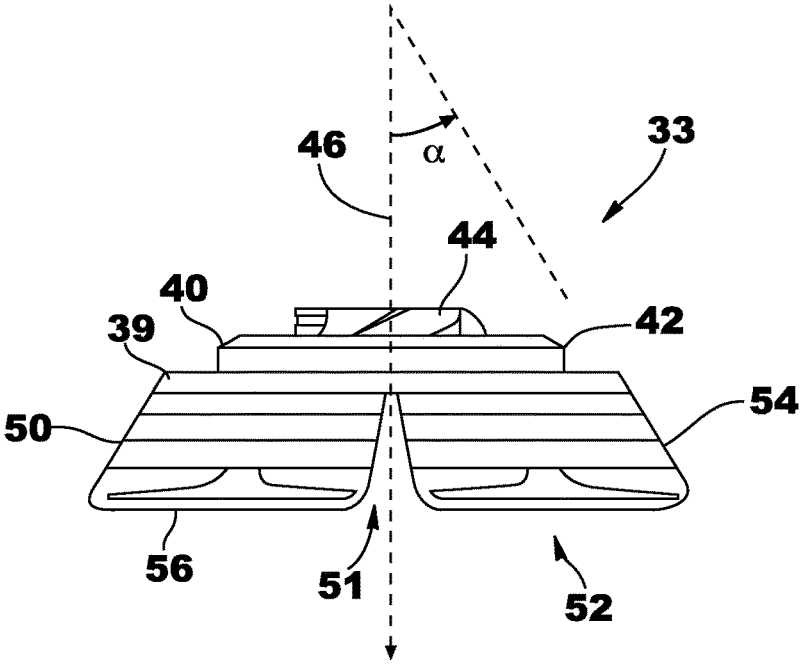
FIG. 4 shows a lateral side elevational view of the golf cleat of FIG. 3.
Figure 5:
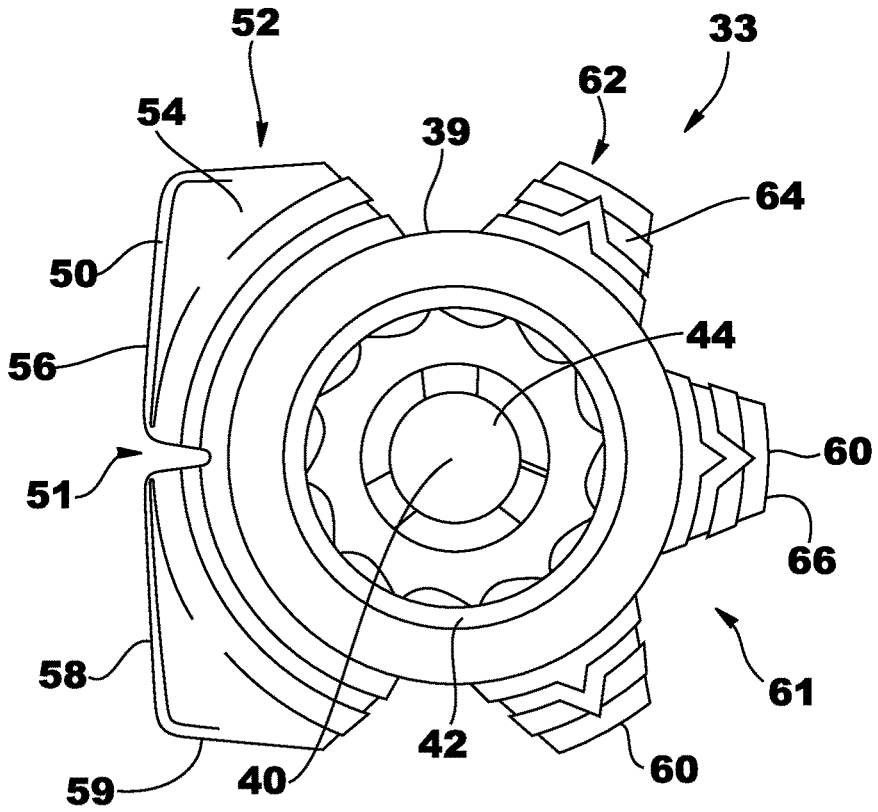
FIG. 5 shows a top plan view of the golf cleat of FIG. 2.

With particular reference now to FIGS. 3-5, an exemplary embodiment of a stability cleat 33 is shown. Each of the plurality of stability cleats 33 includes a mount coupling 40, a hub 39 connected to the mount coupling, and a plurality of legs extending from the hub 39. The plurality of legs include one or more lateral or static legs 50 on a lateral side 52 of the cleat 33 (the lateral hemisphere) and one or more medial or dynamic legs 60 on a medial side 62 of the cleat 33 (the medial hemisphere). As illustrated, the stability cleat 33 does not include any legs on the lateral side 52 other than the static legs 50, and does not include any legs on the medial side 62 other than the dynamic legs 60.

It will be recognized that the terms "lateral side" and "medial side" of the stability cleat 33 are used herein to simply differentiate two different sides of the stability cleat. Although the lateral side of the stability cleat 33 includes static legs 50 that are specifically designed to face outwardly on the sole 24 toward a perimeter (and such static legs 50 may therefore be referenced herein as "lateral legs"), it will be recognized that in some embodiments the static legs 50 of the stability cleat 33 may be oriented to face inwardly, toward a longitudinal centerline on the sole 24. Similarly, although the medial side of the stability cleat 33 includes dynamic legs 60 that are specifically designed to face inwardly on the sole 24 toward the longitudinal centerline (and such dynamic legs 60 may therefore be referenced herein as "medial legs"), it will be recognized that in some embodiments the dynamic legs 60 of the stability cleat 33 may be oriented to face outwardly on the sole 24, toward the perimeter.

The mount coupling 40 includes a perimeter rim 42 on the upper side of the cleat 33 with a short threaded post 44 centrally located within the perimeter rim 42. The threaded post 44 defines an axis of insertion 46 for cleat 33. The cleat 33 is configured to be rotated about the axis of insertion 46 when the cleat 33 engages to the cleat mounts 28 on the sole 24 of the golf shoe 20. Two wrench recesses 48 are provided on the bottom side of the cleat 33. The wrench recesses 48 define recess walls 49 and are configured to receive the prongs of a wrench and facilitate rotation of the cleat 33. The mount coupling 40 is comprised of a material having a sufficient hardness to properly secure the cleat 33 to the cleat mount 28. In at least one embodiment, the mount coupling is a thermoplastic polyurethane (TPU) material having a hardness similar to that of the static legs 50 of the cleat 33.

The one or more static legs 50 extend outwardly and downwardly from the mount coupling 40. The one or more static legs 50 are relatively wide in comparison to the dynamic legs 60. The one or more static legs 50 span across an arc of the cleat 33 that extends about the same distance as an arc spanned by the one or more dynamic legs 60. The one or more static legs include a tapered notch 51 centrally located along the arc of the leg. Each static leg 50 includes a flared outer surface 54 that terminates in a distal end of the static leg 50. The outer surface 54 is angled away from the axis of insertion 46 and defines an angle $\alpha$ relative to the axis of insertion 46. The angle $\alpha$ may be, for example, between 15° and 75°. In the embodiment of FIGS. 3-5, the angle $\alpha$ is about 30°.

A relatively sharp edge 56 is defined at the distal end of the static leg 50. In the embodiment of FIGS. 3-5, the edge 56 is defined along a first segment 58 and a second segment 59. The first segment 58 and the second segment 59 of the edge 56 are both relatively straight and are oriented in a generally perpendicular arrangement relative to one another with a corner provided between the first segment 58 and the second segment 59. As shown in FIG. 2, the first segment 58 is designed to extend substantially parallel to a lateral edge 25 of the sole 24 when the cleat 33 is connected to the shoe 20 in the predetermined orientation, and the second segment 59 is designed to extend substantially perpendicular to the lateral edge 25 of the sole 24. The length of the first segment 58 may be between 7 mm and 25 mm. In at least one embodiment, the length of the first segment is at least 10 mm but less than 20 mm. This length of the first segment 58 is advantageous to provide a sufficient length for the first segment to cut into the ground and provide stability and traction for the foot of the wearer during lateral movement of the body during a golf swing.

The static legs 50 are relatively stiff and defined by a first hardness. In particular, the static legs 50 have a hardness that is significantly greater than the hardness of the dynamic legs 60. In at least one embodiment, the static legs 50 are formed by a TPU material having a shore durometer between 60 D and 80 D. In at least one embodiment, the static legs 50 are defined by a shore durometer of 71 D. By way of example, this shore durometer is similar to that of a typical hard hat used on a construction site. While the static legs 50 have been described herein as being formed by a TPU material with a particular shore durometer, it will be appreciated that any of various materials may be used to form the static legs 50 and the material may have a different shore durometer than that disclosed herein.

With continued reference again to FIGS. 3-5, the one or more dynamic legs 60 also extend outwardly and downwardly from the mount coupling 40. The one or more dynamic legs 60 generally extend toward the medial side of the golf shoe 20. The one or more dynamic legs 60 are relatively narrow in comparison to the static legs 50. A relatively large gap 61 separates each of the one or more legs. A similar sized gap separates the dynamic legs 60 from the static legs 50. The gap 61 is significantly larger than the notch 51 present in the one or more static legs 50. Each dynamic leg 60 includes a flared outer surface 64 that terminates at the distal end of the static leg 50. The outer surface 64 defines an angle relative to the axis of insertion 46. The angle is the same as or similar to the angle $\alpha$.

An edge 66 is defined at the distal end of the dynamic leg 60. In the embodiment of FIGS. 3-5, the edge 66 is curved along an arc that is centered about the axis of insertion 46. The length of the edge 66 on the dynamic legs 60 is significantly less than the length of the edge 56 on the static legs 50 because the dynamic legs 60 are significantly thinner than the static legs 50. In at least one embodiment, the length of the edge 66 may be between 3 mm and 7 mm.

The dynamic legs 60 are relatively flexible compared to the static legs 50. Accordingly, the dynamic legs 60 are defined by a second hardness that is different than the first hardness of the static legs 50. In at least one embodiment, the dynamic legs 60 are formed by a TPU material having a shore durometer between 80 A and 100 A. In at least one embodiment, the dynamic legs 60 are defined by a shore durometer of 90 A. By way of example, this shore durometer is similar to that of a typical hydraulic O-ring. As mentioned previously, the standard cleats 35 may have a hardness that is similar to that of the dynamic legs 60 of the stability cleats 33. While the dynamic legs 60 of the stability cleats 33 have been described herein as being formed by a TPU material with a particular shore durometer, it will be appreciated that any of various materials may be used to form the dynamic legs 60 and the material may have a different shore durometer than that disclosed herein.

Figure 6:
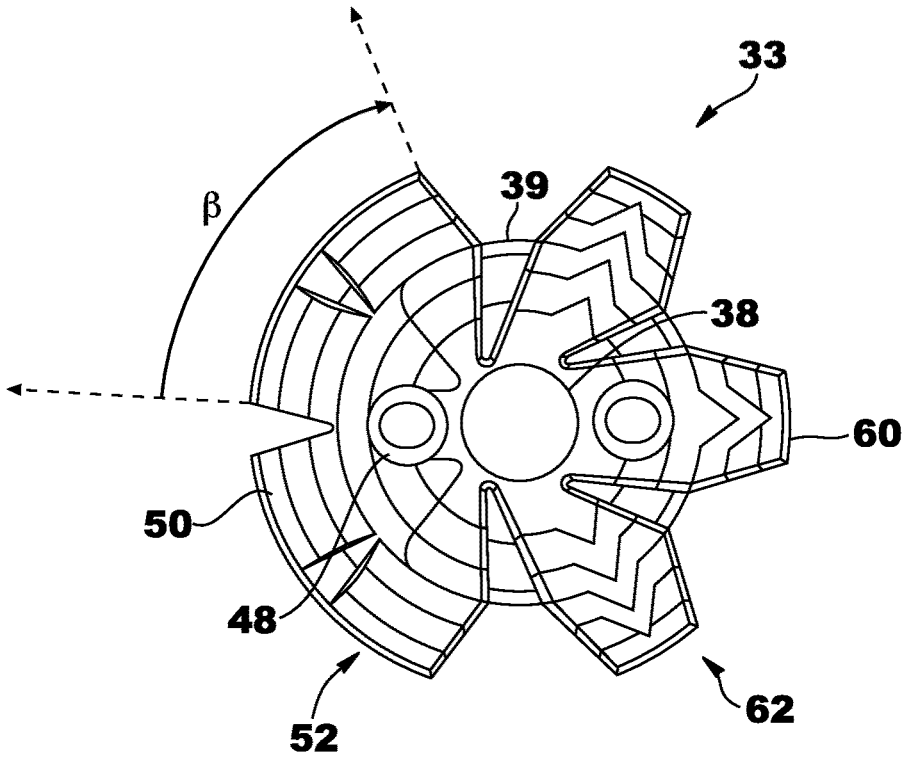
FIG. 6 shows a bottom plan view of an alternative embodiment of the golf cleat of FIG. 3.

With reference now to FIGS. 6-12, an alternative embodiment of the stability cleat 33 is shown. This embodiment is substantially similar to the embodiment of FIGS. 3-5, but in this embodiment, the shape of the static leg 50 is slightly different. In particular, the edge 56 of each static leg 50 in the embodiment of FIGS. 6-12 is curved rather than substantially straight. For example, as shown in FIG. 6, the edge 56 of the static leg 50 extends along an arc defining an angle $\beta$ between 45° and 90°, and particularly about 75°. Accordingly, in the embodiment of FIGS. 6-12, the edge 56 does not include the first portion 58 and the second portion 59 with a corner therebetween, but instead includes a continuously curved edge.

Figure 7:
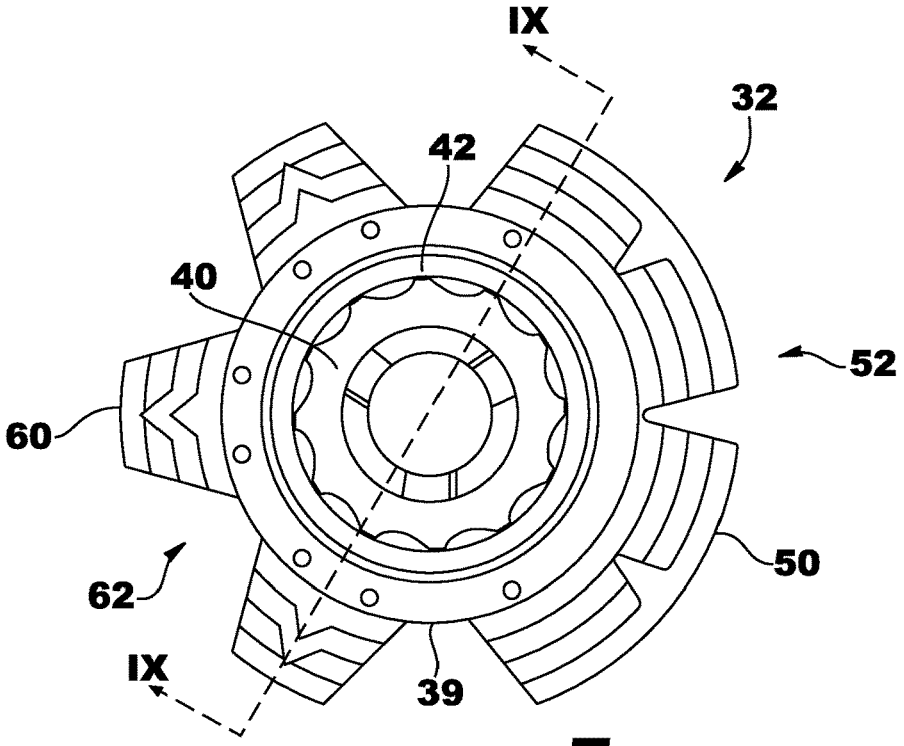
FIG. 7 shows a top plan view of the golf cleat of FIG. 6.
Figure 8:
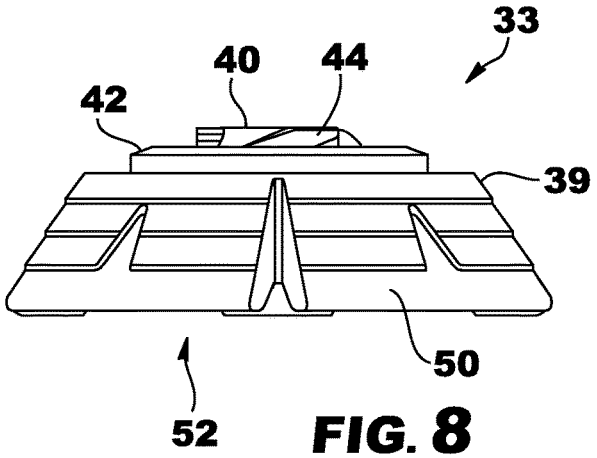
FIG. 8 shows a lateral side elevational view of the golf cleat of FIG. 6.
Figure 9:
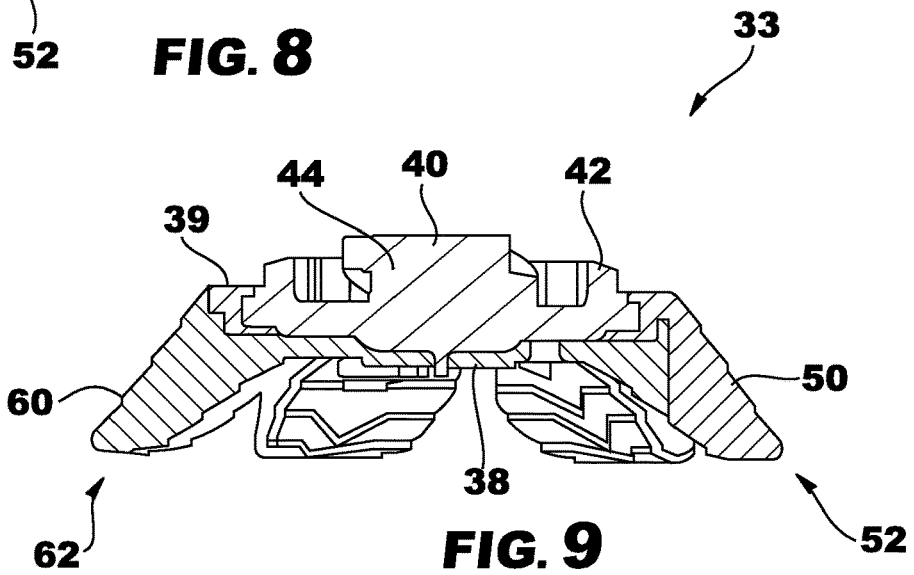
FIG. 9 shows a cross-sectional view of the golf cleat along line IX-IX of FIG. 6.
Figure 10:
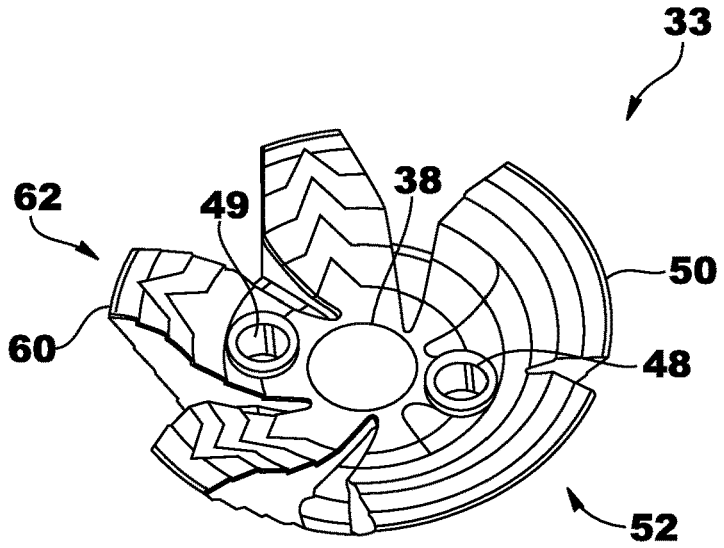
FIG. 10 shows a bottom perspective view of the golf cleat of FIG. 6.
Figure 11:
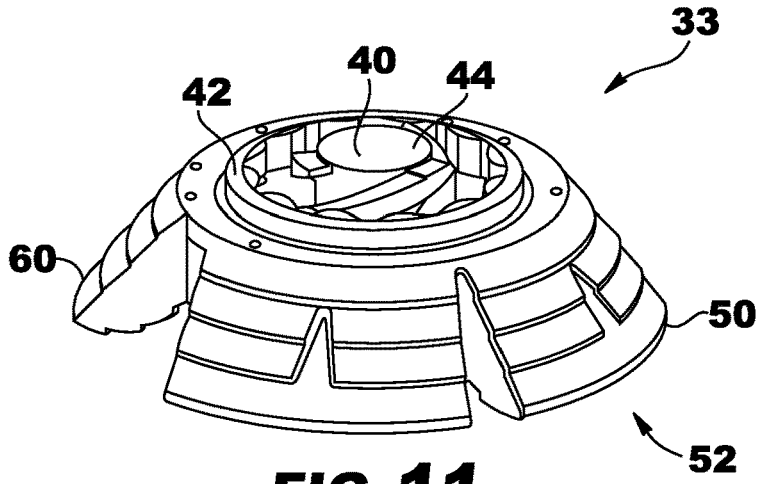
FIG. 11 shows a top perspective view of a lateral side of the golf cleat of FIG. 6.
Figure 12:
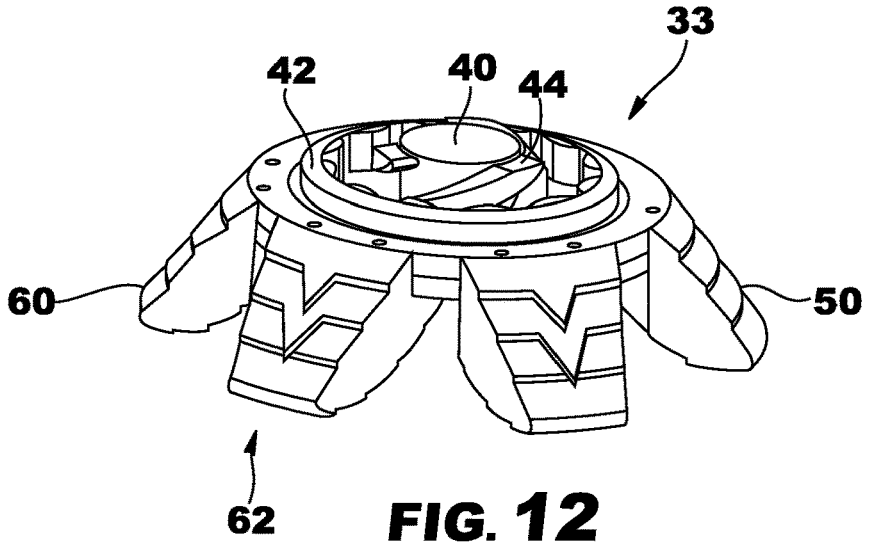
FIG. 12 shows a top perspective view of a medial side of the golf cleat of FIG. 6.

In addition to the difference in the shape of the static leg 50, the materials forming the static legs 50 and the dynamic legs 60 also cover different regions of the cleat 33 in the embodiment of FIGS. 6-12 than in the embodiment of FIGS. 3-5. As shown in FIG. 6, the material forming the static legs 50 and the dynamic legs 60 substantially covers the lower side of the cleat 33, with the wrench recesses 48 extending through the material such that recess walls 49 of the wrench recesses are exposed on the lower side of the cleat 33. The material forming the dynamic legs 60 surrounds the mount coupling 40 on the lower side of the cleat and substantially covers a central portion 38 of the lower side of the cleat 33, without covering the wrench recesses 48. As shown in FIG. 7, the material forming the static legs 50 surrounds the perimeter rim 42 of the mount coupling 40 on the upper side of the cleat 33. Accordingly, both the material that forms the static legs 50 and the material that forms the dynamic legs 60 completely encircles the mount coupling 40 in the embodiment of FIGS. 6-12, with the material that forms the static legs 50 positioned superior to the material that forms the dynamic legs 60 around the mount coupling 40. FIG. 9 shows a cross-sectional view of the cleat 33 with the material that forms the dynamic legs 60 extending across the lower side of the cleat 33 from the medial side 62 to the lateral side 52, and the material that forms the static legs 50 surrounding the mount coupling 40 and extending from the lateral side 52 to the medial side 62.

The cleat 33 is a unitary component that is intractably indivisible. In other words, the mount coupling, static legs 50 and dynamic legs 60 are monolithic and cannot be separated without destruction of one or more components of the cleat 33. In at least one embodiment, the cleat 33 may be formed by a three shot injection molding process wherein a first material is used to form the static legs 50, a second material is used to form the dynamic legs 60, and a third material is used to form the mount coupling 40. As discussed previously, the first material may be a TPU or other polymer having a shore durometer between 70 D and 90 D, the second material may be a TPU or other polymer having a shore durometer between 80 A and 100 A, and the third material may be a TPU or other polymer having a shore durometer similar to the first material. In at least one embodiment, the first material forming the static legs 50 may be a different color from the second material forming the dynamic legs 60. This provides a unique look for the cleat 33 and allows the wearer of the golf shoe 20 to confirm that the cleat 33 is properly oriented on the sole 24. Also, the third material for the mount coupling 40 may be a different color than both the first material and the second material, thus allowing the user to easily locate the threaded post 44 and the wrench recesses 48 when connecting the cleats 33 to the sole 24 of the golf shoe 20.

Figure 13:
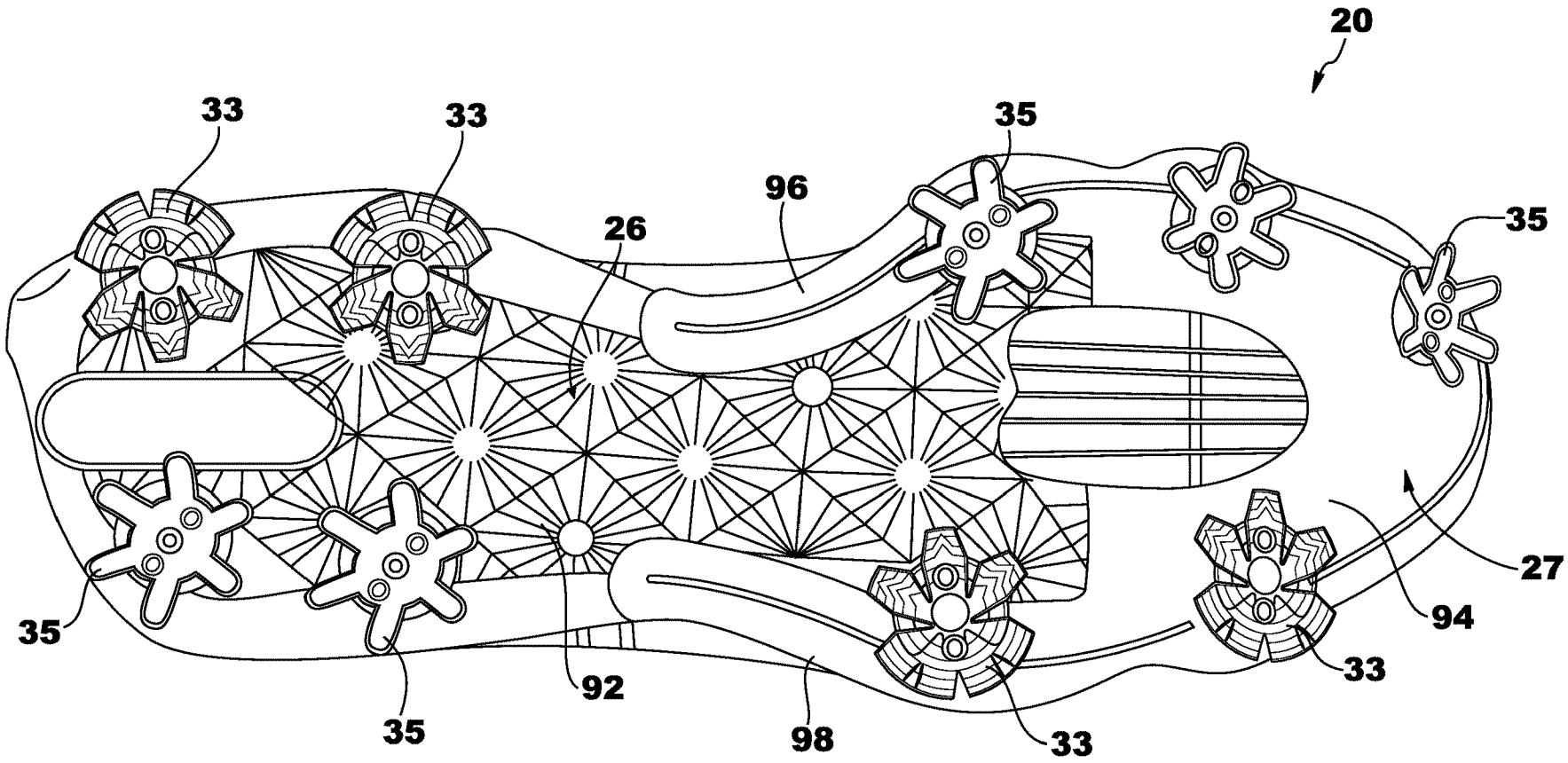
FIG. 13 shows a bottom plan view of an alternative embodiment of the golf shoe of FIG. 1 with the golf cleats in a first configuration.

In operation, the wearer connects each of the cleats 30 to the sole 24 of the golf shoe 20, as shown in FIGS. 2 and 13. In the embodiment of FIG. 2, the stability cleats 33 are connected to the lateral side of the sole 24, and the standard cleats 35 are connected to the medial side of the sole 24. However, in other arrangements, such as that of FIG. 13, the stability cleats 33 and the standard cleats 35 are selectively connected to either the lateral or medial sides of the sole. Each cleat 30 is connected to the sole by inserting the mount coupling 40 of the cleat 30 into the cleat mount 28 and rotating the cleat 30 until it locks in place on the sole. The cleat mounts 28 may be arranged on the sole such that the stability cleats 33 will have a predetermined orientation once secured in the cleat mounts 28. In particular, the static legs 50 of each stability cleat 33 may be limited to positioning along a lateral edge of the sole 24, and extend outwardly toward the perimeter edge of the sole 24. In this configuration, the dynamic legs 60 extend inwardly toward the longitudinal centerline of the golf shoe 20. However, in at least some embodiments, the cleat mounts may be configured such that two or more different orientations for each stability cleat is possible in association with each cleat mount 28. For example, as noted previously, in at least one embodiment, the cleat mounts may be configured such that the static legs may face either outwardly or inwardly on the sole. In yet additional embodiments, three or more orientations of the stability cleat are possible (e.g., each orientation rotated 120°).

While only a single golf shoe 20 has been shown in FIGS. 2 and 13, it will be recognized that the user will typically use two golf shoes, including a first golf shoe 20 on the front foot as defined by the user's swing (i.e., the front foot is the left foot for a golfer with a right handed swing), and a second golf shoe on the back foot as defined by the user's swing (i.e., the back foot is the right foot for a golfer with a right handed swing). In at least one embodiment, only the golf shoe on the front (leading) foot of the user includes the stability cleat 33 with the static legs 50 and the dynamic legs 60. The remaining cleats 30 on the two shoes are all the same and do not include specifically designed static legs 50 and dynamic legs 60. For example, all of the remaining cleats may take the form of standard cleats 35, as shown in FIG. 2. In this embodiment, when the user transfers his or her weight to the front foot during the golf swing, the relatively hard static legs 50 dig into the ground and provide stability and traction for the user on the lateral side of the front foot, thus preventing slippage of the front foot during the golf swing. At the same time, the more flexible legs on the standard cleats 35 on the remaining cleat mounts 28 provide a more typical performance, offering stabilizing features without being overly rigid and stiff as the wearer walks and swings the golf club during a round of golf.

While the embodiment of FIG. 2 provides one exemplary arrangement embodiment for the cleats 30 on a golf shoe of the golfer's front foot, it will be recognized that the wearer may arrange the cleats 30 in any desired arrangement of the golf shoe of the golfer's front or back foot. For example, the wearer may use the stability cleat 33 in one or two cleat mounts 28 along the lateral side of the golf shoe 20, but use the standard cleats 35 in the remaining cleat mounts along the lateral side of the golf shoe. Furthermore, the wearer may use one or more of the stability cleats 33 on the medial side of the golf shoe, or even on the medial or lateral side of the golf shoe of his or her back foot, depending on the traction and stability requirements of the user in association with his or her unique golf swing. Accordingly, the stability cleats 33 have been described in association with FIG. 2 as lateral cleats 32, it will be recognized that in alternative embodiments and configurations that such stability cleats 33 may be selectively positioned on either the lateral side or the medial side of the golf shoe 20 and may be positioned on either the front foot or the back foot of the golfer. Example of such alternative arrangements of the cleats 30 on the golf shoe 20 is shown in FIG. 13.

With reference now to FIG. 13, in at least one embodiment, the golf shoe includes both stability cleats 33 and standard cleats 35 mounted on the medial and lateral sides of the outsole 27. In the embodiment of FIG. 13, the stability cleats 33 are provided on the front lateral side and the rear medial side of the golf shoe 20, and the standard cleats 35 are provided on the front medial side and the rear lateral side of the golf shoe 20. Together, the stability cleats 33 and the standard cleats 35 provide the primary traction members for the golf shoe 20.

Based on the above-described embodiments, it will be recognized that the stability cleats 33 and the standard cleats 35 may be provided in any of numerous configurations on the outsole 27, as desired by the user. Accordingly, the positions of the stability cleats 33 and the standard cleats 35 may be switched to any of various other positions than those shown in FIGS. 2 and 13. For example, all cleats in the cleat mounts on the outsole 27 may be stability cleats 33, no cleats may be stability cleats 33, or any combination of stability cleats 33 and standard cleats 35 may be provided on the cleat mounts 28 of the outsole 27. Therefore, it should be recognized that numerous different configurations and positions for the stability cleats 33 and the standard cleats 35 may be used for the golf shoe.

Because the stability cleats 33 may be arranged in a number of different positions and combinations on the golf shoe 20, cleat arrangements may be customized for different golfers based on their particular golf swing. For example, the arrangement of FIG. 13 with stability cleats 33 on the front lateral side and the rear medial side of the shoe 20 may be preferred for a golfer with a plant foot (i.e., a lead foot) that is relatively flat at finish (i.e., at the finish of the golf swing). FIG. 16A shows the forces experienced on the plant foot of a right handed golfer (i.e., the left foot) with such a finish. In particular, with this type of finish, the plant foot experiences a lateral and counter-clockwise force on the forefoot (as represented by arrow 160), while heel experiences a medial and counter-clockwise force on the heel (as represented by arrow 162). When the stability cleats 33 are arranged on the front lateral portions of the shoe 20 and on the rear medial portions of the shoe (as shown in FIG. 13), the stability cleats 33 will tend to dig into the ground more firmly than standard cleats, thus providing additional rotational traction and thereby preventing counter-clockwise rotation of the feet.

Figure 16B:
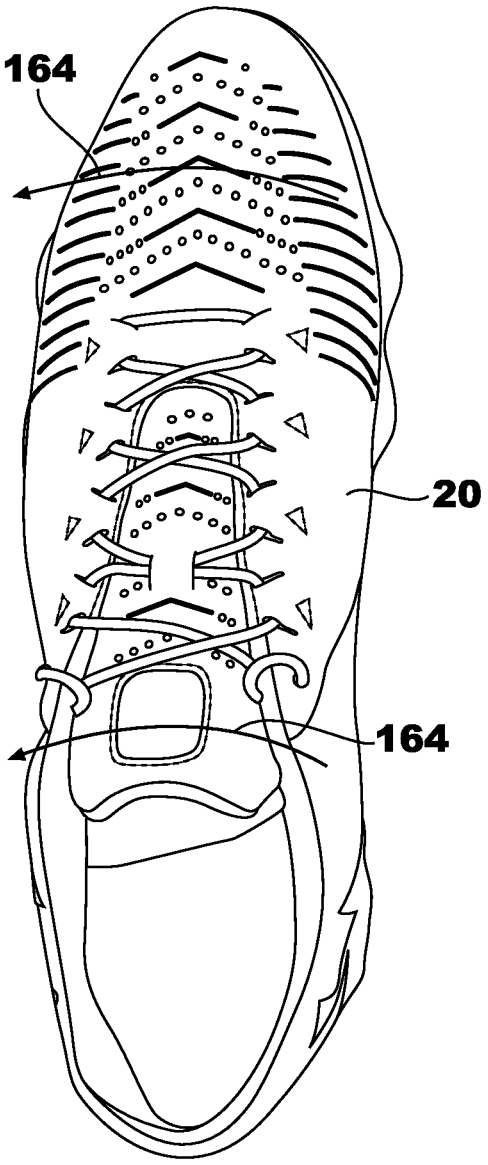
FIG. 16B shows the shoe of FIG. 1 with forward rotational forces applied thereto.

FIG. 16B shows the forces experienced on the plant foot of a golfer with a different type of finish. In particular, this golfer tends to roll his plant foot to the lateral lead side (i.e., to the left side for a right handed golfer) at finish, and experiences primarily lateral rotational forces on both the forefoot and the heel (as represented by arrows 164 in FIG. 16B). As a result, the medial side of the shoe 20 tends to leave the ground at finish for this type of swing with most of the weight of the golfer placed on the lateral side of the foot. A golfer with this type of finish may prefer to use the arrangement of FIG. 2 wherein all of the stability cleats 33 are provided on the lateral lead side of the shoe 20. With this arrangement, the more rigid static leg 50 of the stability cleat 33 will tend to more firmly dig into the ground, thus providing traction and preventing the foot of the golfer from slipping while the plant foot rolls laterally (as illustrated in FIG. 16B). At the same time, this arrangement will also tend to provide additional support on the lateral side of the shoe 20 at finish.

FIGS. 16A and 16B illustrate two common types of forces that may be experienced by golfers during their swing, and especially at finish. Various other types of forces may also be experienced, both at finish and during the golf swing for each golfer. Accordingly, different golfers may find it beneficial to add rotational traction to various locations on his or her feet to counter various forces, and particularly rotational forces. Accordingly, it will be recognized that any combination of arrangements of stability cleats 33 and traditional cleats 35 may be used on the shoe 20, depending on the specific needs of each golfer.

In addition to the primary traction members provided by the cleats 30, the outsole 27 may further include secondary traction members 80, as shown in the embodiment of FIGS. 15A-15D. The secondary traction members may include one or more protrusions 90 that protrude outward on the downward facing surface 26. The protrusions may be provided in any number of different forms, such as spikes, obelisks, inverted pyramids, or other polyhedron structures. In the embodiments of FIGS. 15A-15D, the secondary traction members 80 on the downward facing surface 26 further include faceted traction members 81 provided by polyhedron structures on the sole that form facets 82, ridges 84, and grooves 86.

Figure 15A:
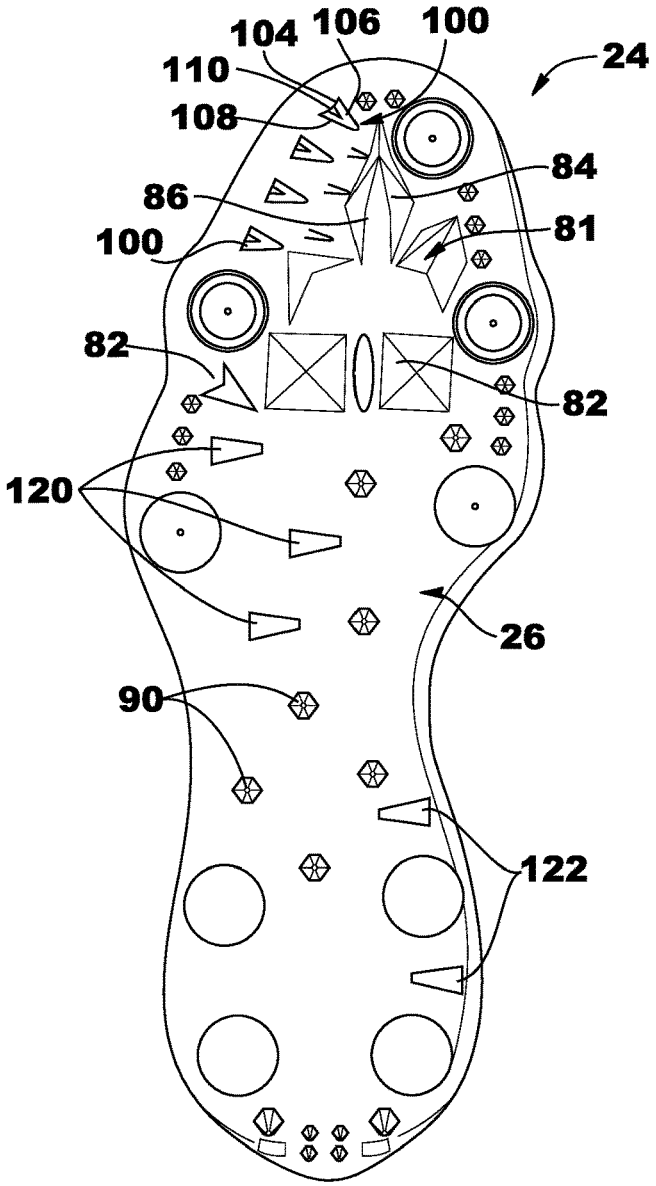
FIG. 15A shows a bottom view of an outer surface of the outsole of FIG. 13, the outer surface including a plurality of secondary traction members.
Figure 15B:
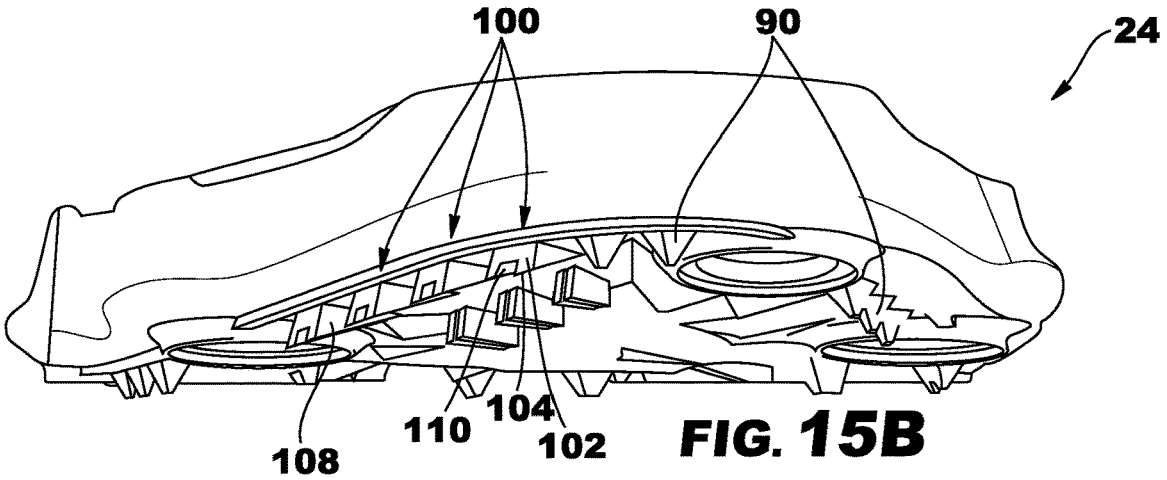
FIG. 15B shows front perspective view of the outer surface of the outsole of FIG. 15A.
Figure 15C:
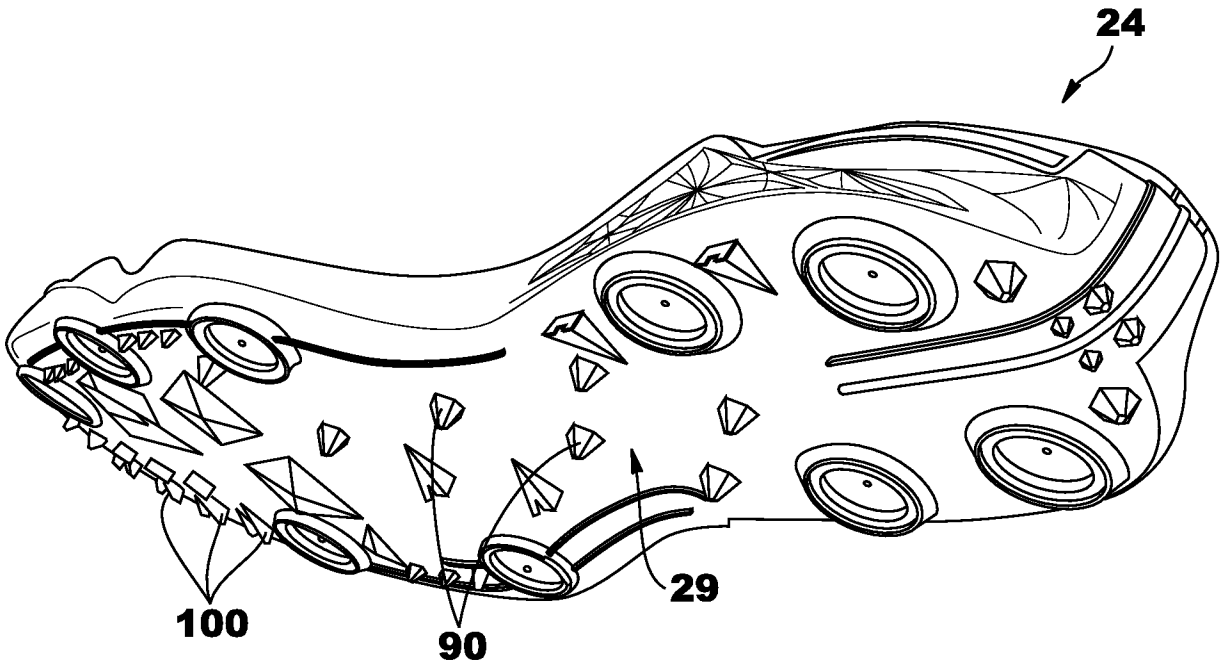
FIG. 15C shows a rear perspective view of the outer surface of the outsole of FIG. 15A.
Figure 15D:
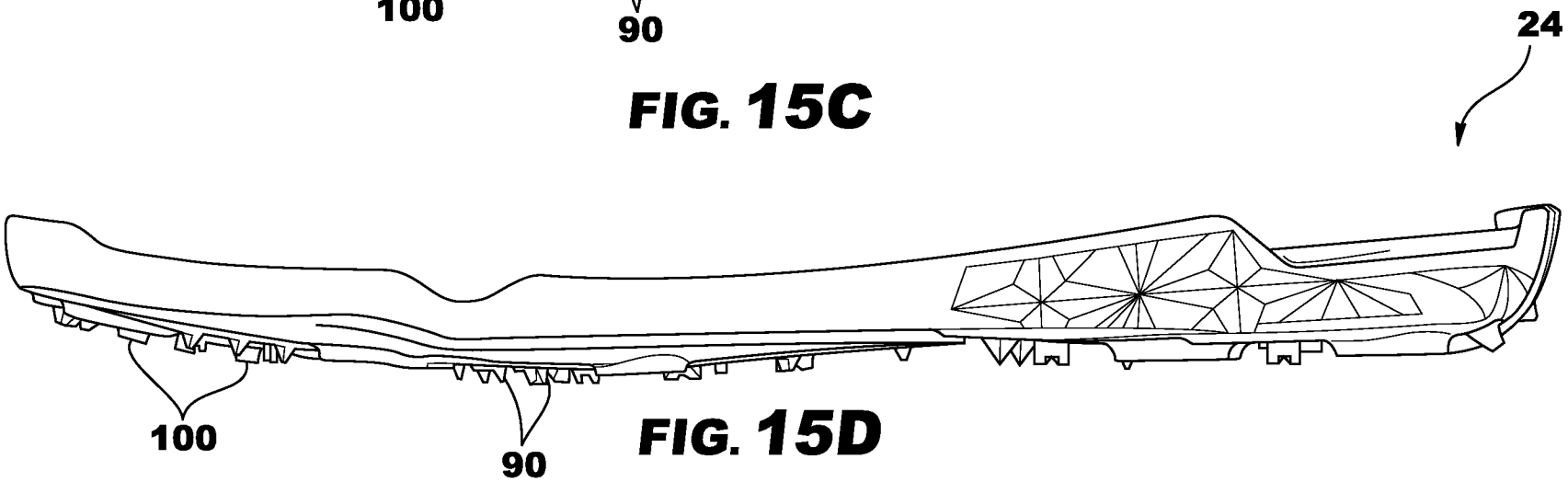
FIG. 15D shows a side view of the outer surface of the outsole of FIG. 15A.

As shown in FIGS. 15A-15D, in at least one embodiment the protrusions 90 include a plurality of secondary stability members 100 provided in the shape of tetrahedron-like structures. The secondary stability members 100 are positioned along the lateral perimeter of the forefoot region of the sole 24. Each secondary stability member 100 includes a substantially vertical perimeter wall 102 that extends to a sharp edge 104. A sloped surface 106 extends inwardly from the edge 104, the sloped surface 106 having a relatively gradual slope. Triangular sidewalls 108 are provided along the sides of the secondary stability member 100. A notch 110 with sharp borders is defined along the edge 104. Similar to the static legs 50 of the stability cleats 33, the secondary stability members 100 are configured to dig into the ground and prevent rotation of the sole 24 during the golf swing. In particular, a sharp angle is defined at the edge 104 where the perimeter wall 102 meets the sloped surface 106, and accordingly the edge 104 is configured to cut into the ground when a rotational force is imparted to the shoe 20. While the secondary stability members 100 have been described herein as being positioned along the lateral forefoot region of the sole 24, it will be recognized that the secondary stability members 100 may also be positioned at other locations on the sole. For example, as shown in FIG. 15A, the secondary stability members 100 may be positioned in lateral midfoot regions 120 near the perimeter or even longitudinal centerline of the sole, and medial heel regions 122 near the perimeter of the sole.

Figure 14:
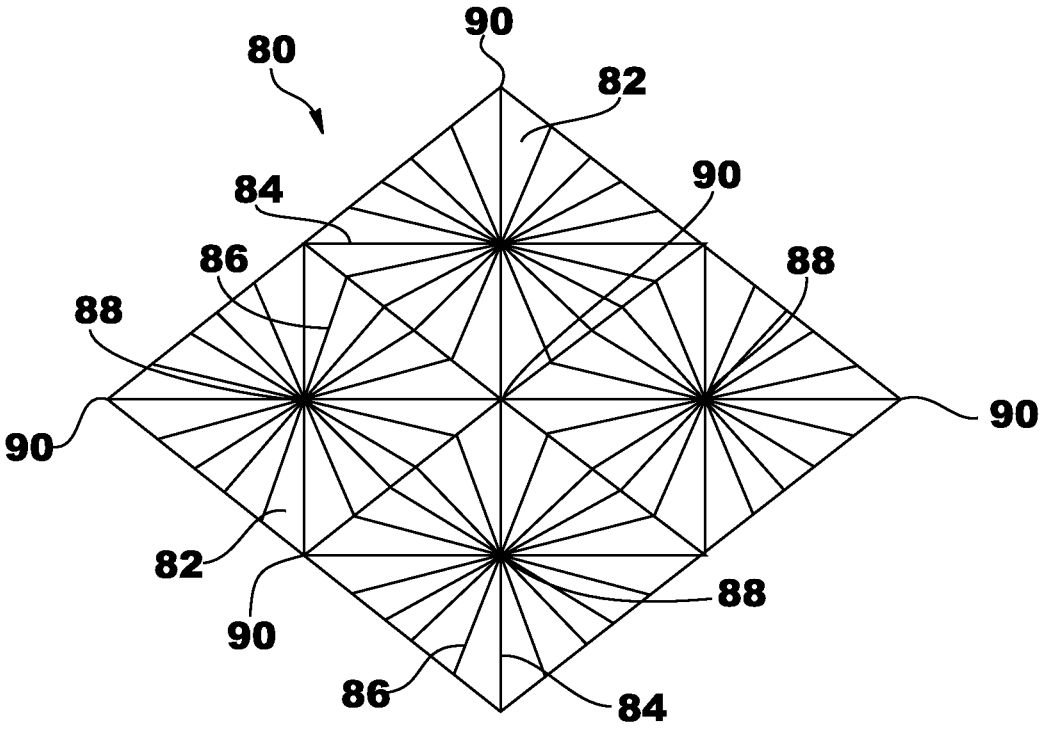
FIG. 14 shows an enlarged view of a group of polyhedron structures visible on the outsole of FIG. 13.

FIG. 14 shows a detailed view of a repeating pattern of polyhedron structures that may be visible on the sole. In at least one embodiment, the repeating pattern of polygon structures may be provided on the outer surface of the sole and provide the secondary traction members 80 (similar to the faceted traction members 81 on the forefoot as shown in FIG. 15A). As shown in FIG. 14, each polyhedron structure is provided with a diamond-shaped base with a trough 88 at the center and a number of facets 82 extending away from the trough 88 with ridges 84 and grooves 86 formed between the facets 82. The repeating pattern of polyhedron structures result in a number of troughs 88 and a number of peaks 90. While FIG. 14 shows four polyhedron structures with diamond-shaped bases, it will be recognized that the outsole 27 may include additional polyhedron structures, fewer polyhedron structures, or partial polyhedron structures as shown in FIG. 13. Moreover, it will be recognized that the polyhedron structures of FIGS. 13 and 14 are but one exemplary embodiment of secondary traction members 80 that may be provided on the outsole, and numerous additional embodiments of differently shaped polyhedron structures and associated configurations are possible, including those secondary traction members discussed in association with FIGS. 15A-15D.

While the repeating pattern of polygon structures including facets 82, ridges 84, grooves 86, troughs 88 and peaks 90 have been disclosed herein as being providing secondary traction members, in at least one alternative embodiment, the repeating pattern of polygon structures is covered by a transparent bottom layer on the outsole. In this embodiment, the repeating pattern of polygon structures are merely visible on the outsole, but do not provide secondary traction members. In this case, the exterior surface of the outsole may include protrusions 90 such as those of FIG. 15A, which are formed on the transparent bottom layer of the outsole in order to provide the secondary traction members. The protrusions may be provided in any number of different forms, such as spikes, obelisks, inverted pyramids, or other polyhedron structures.

With reference again to FIG. 13, in at least one embodiment, the outsole 27 is provided as a multi-component outsole. In the embodiment of FIG. 13, the outsole 27 includes a rearward member in the form of a heel plate 92 and a forward member in the form of a toe plate 94, with the secondary traction elements 80 provided on one or both of the heel plate 92 and the toe plate 94. The heel plate 92 is generally harder than the toe plate 94. In at least one embodiment, both the heel plate 92 and the toe plate 94 are comprised of a thermoplastic polyurethane material (TPU), or other elastomer material. Because the heel plate 92 is harder than the toe plate 94, the durometer of the TPU of the heel plate is greater than the durometer of the TPU of the toe plate. Accordingly, the toe plate 94 tends to flex more easily than the heel plate 92. This provides the user with significant comfort when walking while also offering desired flex regions and stability regions during the golf swing.

The toe plate 94 extends around a perimeter of the outsole 27 from the medial side of a midfoot region, around the toe region, and to a lateral side of the midfoot region. The toe plate 94 covers the entire toe region, but only covers the perimeter of the midfoot region. Accordingly, a medial arm 96 and a lateral arm 98 extend into the midfoot region with the heel plate 92 positioned in the midfoot region between the medial arm 96 and the lateral arm 98. In particular, the medial arm 96 may extend along a region of the sole that is associated with a medial plantar fascia region of the foot, extending along the metatarsal bones and as far as the tarsal bones. Similarly, the lateral arm may extend along a region of the sole that is associated with the lateral plantar fascia region of the foot, extending along the metatarsal bones and as far as the tarsal bones. The forward end of the heel plate 92 extends along a region of the sole associated with the plantar aponeurosis region of the foot, similarly extending from the tarsal bones, along the metatarsal bones and as far as the phalangeal bones. As a result, as shown in FIG. 13, the toe plate 94 provides a horseshoe-shaped structure on the outsole 27 with a perimeter arcing structure that is contoured around a toe region and midfoot region with a central opening within the perimeter arcing structure (i.e., the medial arm 96 and the lateral arm 98 defined a central opening in the toe plate 94 in midfoot region and the heel plate 92 extends into this central opening).

The arms 96 and 98 of the toe plate 94 have a width between about 1 cm and 3 cm, depending on the size of the shoe, the width extending from an outer perimeter to an inner perimeter of the arm. For example, in at least one embodiment, the arms 96 and 98 may have a width of about 1.5 cm for a men's size nine shoe. The arms 96 and 98 have a length between about 6 cm and 16 cm, depending on the size of the shoe, the length extending from the proximal end to the distal end of the arm. For example, in at least one embodiment, the arms 96 and 98 may have a length of about 10 cm for a men's size nine shoe. This configuration of the heel plate 92 and the toe plate 94 in combination with the primary and secondary traction members provides an advantageous outsole 27 with advantageous flex and stability properties for the user when playing golf.

The foregoing detailed description of one or more exemplary embodiments of the athletic cleat has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. For example, while the article of footwear has been disclosed herein as a golf shoe, it will be recognized that the article of footwear may be provided in different forms in alternative embodiments. For example, the article of footwear may be provided as a baseball shoe, a football shoe, a soccer shoe, or any of various other types of articles of footwear that utilize cleats on the sole. Therefore, the spirit and scope of any appended claims should not be limited to the description of the exemplary embodiments contained herein.

What is claimed is:

1. A cleat for an article of footwear comprising:

a mount coupling provided on an upper side of the cleat and configured to engage a sole of the article of footwear;

a hub provided on a lower side of the cleat and is connected to the mount coupling; and a plurality of legs extending from the hub, the plurality of legs including at least one first leg on a medial side of the hub and at least one second leg on a lateral side of the hub, the at least one first leg comprised of a first material having a first hardness and the at least one second leg comprised of a second material having a second hardness, the first hardness different from the second hardness;

wherein the first material surrounds the mount coupling including a perimeter rim of the mount coupling on the upper side of the cleat; and wherein the second material covers a central portion of the mount coupling on the lower side of the cleat.

2. The cleat of claim 1 wherein the first hardness is between 60 D and 80 D shore durometer and the second hardness is between 80 A and 100 A shore durometer.

3. The cleat of claim 1 wherein the first hardness is greater than the second hardness.

4. The cleat of claim 1 wherein the second hardness is greater than the first hardness.

5. The cleat of claim 1 wherein the mount coupling is configured to orient the cleat in a predetermined orientation with the at least one first leg on a lateral side of the article of footwear and the at least one second leg on a medial side of the article of footwear when the mount coupling engages the sole of the article of footwear.

6. The cleat of claim 5 wherein the lateral side of the hub does not include any legs other than the at least one lateral leg and the medial side of the hub does not include any legs other than the at least one medial leg.

7. The cleat of claim 1 wherein the at least one first leg includes a first leg end defining a first edge, wherein the at least one second leg includes a second leg end defining a second edge, wherein the first edge is significantly longer than the second edge.

8. The cleat of claim 7 wherein the first edge is at least 10 mm in length.

9. The cleat of claim 1 wherein the mount coupling defines an axis of insertion, and wherein the at least one first leg and the at least one second leg are angled away from the axis of insertion between 30° and 75°.

10. The cleat of claim 1 wherein the mount coupling includes a plurality of wrench recesses defined by recess walls exposed on the lower side of the cleat.

11. The cleat of claim 1 wherein the first material is TPU having a shore durometer of about 71 D and the second material is TPU having a shore durometer of about 90 A.

12. An article of footwear comprising:

at least one first cleat mounted on a lateral side of the article of footwear, the at least one first cleat including a mount coupling at least one lateral leg and at least one medial leg, the at least one lateral leg comprised of a first material having a first hardness and at least one medial leg comprised of a second material having a second hardness, the first hardness greater than the second hardness, wherein the first material surrounds the mount coupling including a perimeter rim of the mount coupling, and wherein the second material covers a central portion of the mount coupling on the lower side of the cleat; and at least one second cleat mounted on a medial side of the article of footwear, the at least one second cleat including legs, wherein all the legs of the at least one second cleat have a same hardness that is less than the first hardness.

13. The article of footwear of claim 12 wherein the first hardness is greater than the second hardness.

14. The article of footwear of claim 12 wherein the at least one lateral leg includes a lateral leg end defining a first edge, wherein the at least one medial leg includes a medial leg end defining a second edge, wherein the first edge is significantly longer than the second edge.

15. A cleat configured for connection to an article of footwear including a sole, the cleat comprising:

a mount coupling configured to engage the sole of the article of footwear, the mount coupling defining a perimeter edge on an upper side of the cleat;

a hub positioned below the mount coupling on a lower side of the cleat; and a plurality of legs extending from the hub, the plurality of legs including at least one first leg and at least one second leg, the at least one first leg comprised of a first material having a first hardness and the at least one second leg comprised of a second material having a second hardness, the first hardness different from the second hardness;

wherein the first material surrounds the perimeter edge of the mount coupling on the upper side of the cleat; and wherein the hub is comprised of the second material.

16. The cleat of claim 15 wherein the first hardness is between 60 D and 80 D shore durometer and the second hardness is between 80 A and 100 A shore durometer.

17. The cleat of claim 15 wherein the first hardness is greater than the second hardness.

18. The cleat of claim 15 wherein the mount coupling is configured to orient the cleat in a predetermined orientation with the at least one first leg on a lateral side of the article of footwear and the at least one second leg on a medial side of the article of footwear when the mount coupling engages the sole of the article of footwear.

19. The cleat of claim 18 wherein a lateral side of the hub does not include any legs other than the at least one first leg and a medial side of the hub does not include any legs other than the at least one second leg.

20. The cleat of claim 15 wherein the at least one first leg includes a first leg end defining a first edge, wherein the at least one second leg includes a second leg end defining a second edge, wherein the first edge is significantly longer than the second edge.

* * * * *